US006441800B1

(12) United States Patent
Chan et al.

(10) Patent No.: US 6,441,800 B1
(45) Date of Patent: Aug. 27, 2002

(54) SINGLE GIMBAL MULTIPLE APERTURE ANTENNA

(75) Inventors: Ronald Y. Chan, Torrance; Daniel R. Lane, Santa Monica, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/862,632

(22) Filed: May 22, 2001

(51) Int. Cl.[7] ..... H01Q 21/00

(52) U.S. Cl. ..... 343/879; 343/765; 343/770; 244/158 R

(58) Field of Search ..... 343/879, 765, 343/766, 767, 770, 786, 753, 754, 878, 882; 244/158 R, 170, 171, 173, 164, 165; 318/625, 3; 342/350, 354, 355, 372, 377; 370/316

(56) References Cited

U.S. PATENT DOCUMENTS 5,556,058 A * 9/1996 Bender ..... 244/164
6,014,372 A * 1/2000 Kent et al. ..... 370/316
6,017,003 A * 1/2000 Mullins ..... 244/173
6,037,737 A * 3/2000 Bupp et al. ..... 318/609
6,210,512 B1 * 4/2001 Jones ..... 144/358

* cited by examiner

*Primary Examiner*—Tan Ho
(74) *Attorney, Agent, or Firm*—Harness, Dickey & Pierce, P.L.C.

(57) ABSTRACT

An antenna system for a satellite including a gimbal device, such as a bi-axial gimbal, that employs a first uni-axial gimbal providing movement in one direction and a second uni-axial gimbal providing movement in a perpendicular direction. The first gimbal is mounted to a platform bracket, which is part of a moveable platform. The first gimbal is also mounted to the second gimbal, and the second gimbal is mounted to a satellite bracket secured to the satellite. Both a receive antenna array and a transmit antenna array are mounted to the moveable platform. Therefore, movement of the first gimbal causes the combination of the receive and transmit antenna arrays to move in one direction, and movement of the second gimbal causes the combination of the receive and transmit antenna arrays to move in the perpendicular direction.

18 Claims, 1 Drawing Sheet

SINGLE GIMBAL MULTIPLE APERTURE ANTENNA

BACKGROUND OF THE INVENTION

1. Field of the Invention

This invention relates generally to a platform for an antenna and, more particularly, to a platform for an antenna system on a satellite that supports both a receive antenna array and a transmit antenna array, where the platform is movable by a single antenna positioning device.

2. Discussion of the Related Art

Various communications systems, such as certain cellular telephone systems, cable television systems, Internet systems, military communications systems, etc., make use of satellites orbiting the Earth to transfer signals. One example is the Military Satellite Communications (MILSATCOM) satellites, known to those skilled in the art. A satellite uplink communications signal is transmitted to the satellite from one or more ground stations, and then re-transmitted by the satellite to another satellite or to the Earth as a downlink communications signal to cover a desirable reception area depending on the particular use. The uplink and downlink signals are typically transmitted at different frequencies, are polarized and coded. or example, the uplink communications signal may be transmitted at 30 GHz and the downlink communications signal may be transmitted at 20 GHz.

The satellite is equipped with an antenna system including a configuration of antenna arrays, such as feed horn arrays, slot arrays, etc., which receive the uplink signals and transmit the downlink signals to the Earth. Additionally, the antenna system may employ antenna reflectors for collecting and directing both the uplink and downlink signals. In order for the antenna beams to be directed towards a particular location on the Earth, the antenna system is equipped with mechanical positioning devices that can direct the antenna beams to different locations. For example, gimbals are provided to move the antenna arrays so that the uplink signals can be received from a particular location on the Earth, and the downlink signals can be directed to a particular location on the Earth. A separate gimbal is generally provided for the transmit and receive antenna arrays so that signals can be received from and transmitted to different locations.

As is well understood in the art, it is desirable to minimize the size and weight of the satellite payload so as to conserve satellite real estate, and to reduce costs. By conserving satellite real estate, more satellite systems can be provided without increasing the satellite size. By reducing the weight of the satellite, significant cost is saved in the consumption of fuel and the like. Antenna gimbals are a primary target for reducing the weight of the satellite payload because they are heavy and sizable. Therefore, it has heretofore been known in the art to eliminate at least some of the antenna gimbals on the satellite. For example, it is known to only employ a gimbal for one of the receive or transmit arrays, and fixedly attach the other to the satellite. However, such a system is limited in its function and performance because of the directional limitations of the fixed antenna array.

It is also known in the art to use the same antenna system, including antenna array, on the satellite to receive the uplink signals and transmit the downlink signals. However, combining satellite uplink signal reception and downlink signal transmission functions in a single antenna system typically requires specialized antenna feeds capable of supporting dual frequencies and providing dual polarization. Because of this requirement, these types of antenna systems are much more complex and expensive than the single function antenna systems.

SUMMARY OF THE INVENTION

In accordance with the teachings of the present invention, an antenna system for a satellite is disclosed. The antenna system includes a receive antenna array and a transmit antenna array mounted to a common platform. An antenna positioning device is mounted to the platform and to the satellite. The positioning device causes the platform to be moved in two separate orthogonal degrees of freedom, and particularly in the longitudinal and latitudinal directions relative to the Earth. Thus, instead of employing separate positioning devices for both the receive antenna array and the transmit antenna array, a single positioning device is provided for both arrays.

The positioning device can be any suitable satellite antenna positioning system known in the art, such as uni-axial and bi-axial gimbals, wobble plates employing linear actuators, and compact small angle positioning devices using a polar coordinate system. In one embodiment, the positioning device is a gimbal device that employs a first uni-axial gimbal providing movement in one direction and a second uni-axial gimbal providing movement in a perpendicular direction. The first gimbal is mounted to a platform bracket, which is secured to the movable platform. The first gimbal is also mounted to the second gimbal, and the second gimbal is mounted to a satellite bracket secured to the satellite. Therefore, movement of the first gimbal causes the combination of the receive and transmit antenna arrays to move in one direction, and movement of the second gimbal causes the combination of the receive and transmit antenna arrays to move in the perpendicular direction.

Additional objects, features and advantages of the present invention will become apparent from the following description and appended claims taken in conjunction with the accompanying drawings.

DETAILED DESCRIPTION OF THE EMBODIMENTS

Figure 1:
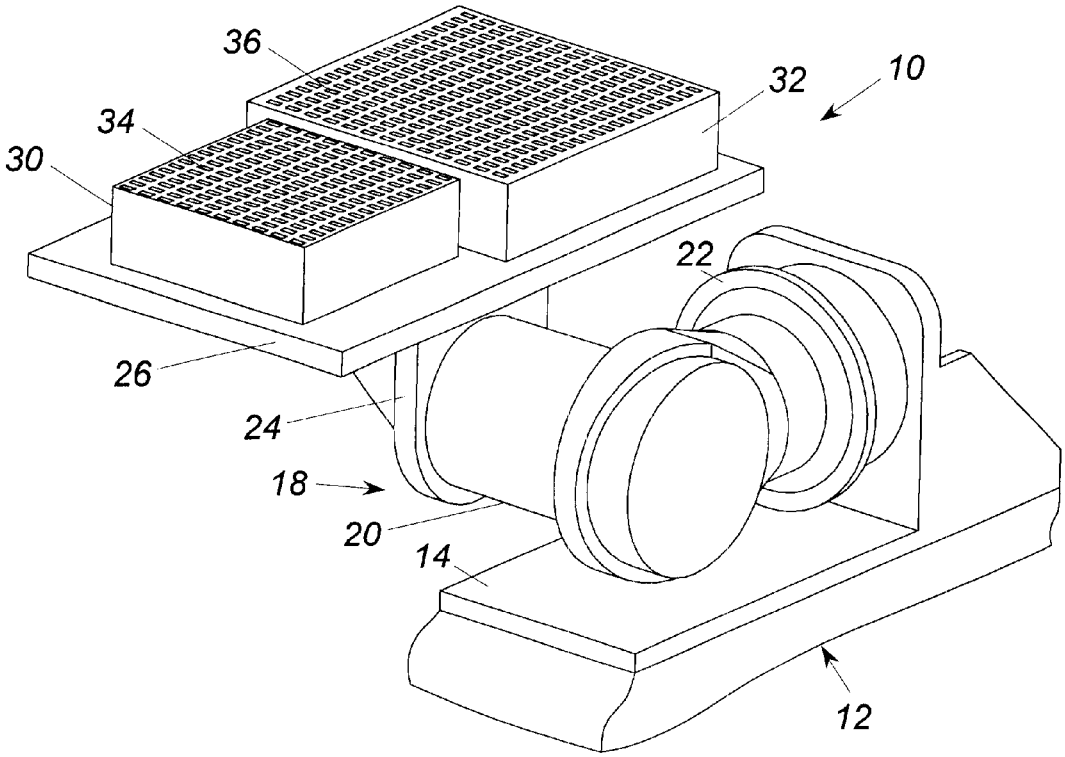
FIG. 1 is perspective view of an antenna system including a bi-axial gimbal mounted to a satellite, according to an embodiment of the present invention.

The following discussion of the embodiments of the invention directed to a positioning device for an antenna system on a satellite is merely exemplary in nature, and is in no way intended to limit the invention or its applications or uses.

FIG. 1 is a perspective view of an antenna system 10 mounted to a satellite 12, according to an embodiment of the present invention. The antenna system 10 includes an L-shaped mounting bracket 14 that is fixably mounted to the satellite 12, and can be any bracket suitable for the purposes described herein. The antenna system 10 further includes a bi-axial gimbal system 18 including a first uniaxial gimbal 20 and a second uni-axial gimbal 22. As will be discussed below, employing the gimbal system 18 is by way of a non-limiting example, in that other antenna system positioning devices on the satellite can also be employed. Bi-axial gimbals of this type are well known to those skilled in the art for moving an object in two degrees of freedom that are perpendicular to each other.

The uni-axial gimbal 20 is mounted to an antenna bracket 24 that is part of an antenna platform 26, and the uni-axial gimbal 22 is mounted to the bracket 14. Further, the uni-axial gimbals 20 and 22 are mounted to each other. Therefore, when the uni-axial gimbal 22 is activated, both the uni-axial gimbal 20 and the platform 26 move, and when the uni-axial gimbal 20 is activated, the platform 26 moves. In this example, the bi-axial gimbal system 18 is mounted to the bracket 14 so that the uni-axial gimbal 22 moves in a longitudinal direction relative to the Earth, and the uni-axial gimbal 20 moves in a latitudinal direction relative to the Earth.

A receive antenna array 30 and a transmit antenna array 32 are mounted to the platform 26 proximate each other, as shown. Antenna arrays are mounted to the platform 26 in this example, however, as will be appreciated by those skilled in the art, other types of antennas and antenna systems can also be mounted to the platform 26 without departing from the spirit and scope of the present invention. The arrays 30 and 32 define separate antenna apertures. In this example, the antenna arrays 30 and 32 are slot antenna arrays including a plurality of antenna slots 34 and 36, respectively. However, this is by way of a non-limiting example, in that any type of antenna array suitable for the purposes described herein, can be used in place of the arrays 30 and 32. The receive array 30 is smaller than the transmit array 32 because the frequency of the uplink signal is greater than the frequency of the downlink signal in this example. Therefore the aperture of the slots 34 have to be smaller than the aperture of the slots 36.

In this configuration, a single bi-axial gimbal is used to move a receive antenna array and the transmit antenna array in combination so that they are directed in the same direction. Because the antenna system does not employ a separate bi-axial gimbal for both the receive antenna array 30 and the transmit antenna array 32, the weight and complexity of multiple gimbals is avoided. Further, because there is a separate antenna array for both the transmit and receive functions, the complexity associated with a dual function antenna system is also avoided.

invention as discussed above discloses a gimbal system for moving the receive antenna array 30 and the transmit antenna array 32 in conjunction with one another by a single positioning device. However, the use of the bi-axial gimbal system 18 is by way of a non-limiting example, in that other positioning devices can also be used that are suitable for the purposes described herein. Examples of other positioning systems include wobble plates employing linear actuators, compact small angle positioning devices employing a polar coordinate system, and uni-axial gimbals. Those skilled in the art would recognize how these and other devices can be used to replace the gimbal system 18.

As mentioned above, the antenna arrays 30 and 32 can be replaced with other types of antennas suitable for use on a satellite. Other types of antennas include antenna feed horns and various types of antenna feeds, antenna reflectors, and antenna lenses. Those skilled in the art will readily recognize the various types of antennas that can be used for the purposes described herein, and the various combinations.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system for a satellite comprising:

a bracket mounted to the satellite;

an antenna platform;

a plurality of separate antennas mounted to the platform; and an antenna platform positioning device mounted to the bracket and the antenna platform, said positioning device causing the platform to move in at least one degree of freedom relative to the satellite so as to move the plurality of separate antennas in conjunction with each other.

2. The antenna system according to claim 1 wherein the positioning device is selected from the group consisting of gimbals, wobble plates and compact small angle positioning devices.

3. The antenna system according to claim 1 wherein the positioning device moves the platform in two orthogonal degrees of freedom.

4. The antenna system according to claim 1 wherein the positioning device is a bi-axial gimbal, including a first uni-axial gimbal device and a second uni-axial gimbal device for moving the platform in two degrees of freedom.

5. The antenna system according to claim 4 wherein the first gimbal device moves in a direction of one of either a longitudinal or latitudinal direction relative to the Earth and the second gimbal device moves in the other of the longitudinal or latitudinal direction.

6. The antenna system according to claim 1 wherein the plurality of antennas are a plurality of antenna arrays.

7. The antenna system according to claim 6 wherein the plurality of antenna arrays include a receive antenna array and a transmit antenna array.

8. The antenna system according to claim 6 wherein the antenna arrays are slot arrays.

9. An antenna system for a satellite comprising:

a satellite bracket mounted to the satellite;

a bi-axial gimbal including a first uni-axial gimbal device and a second uni-axial gimbal device, said first gimbal device being mounted to the satellite bracket and said second gimbal device being mounted to the first gimbal device, said first gimbal device being movable in a first direction and said second gimbal device being movable in a second direction, wherein the first and second directions are perpendicular to each other;

an antenna platform mounted to the second gimbal device; and a receive antenna array and a transmit antenna array mounted to the antenna platform, wherein activation of either the first gimbal device or the second gimbal device moves the platform.

10. The antenna system according to claim 9 wherein the first gimbal device moves in a direction of one of either a longitudinal or latitudinal direction relative to the Earth and the second gimbal device moves in the other of the longitudinal or latitudinal direction.

11. The antenna system according to claim 9 wherein the receive antenna array is smaller than the transmit antenna array.

12. The antenna system according to claim 9 wherein the antenna arrays are slot arrays.

13. A method of moving a transmit antenna array and a receive antenna array on a satellite in unison, said method comprising:

mounting an antenna positioning device to the satellite;

mounting an antenna platform to the positioning device;

mounting a transmit antenna and a receive antenna to the antenna platform; and activating the positioning device to simultaneously position the transmit and receive antennas.

14. The method according to claim 13 wherein activating the positioning device includes moving the platform in two orthogonal degrees of freedom.

15. The method according to claim 13 wherein mounting the positioning device to the satellite includes mounting a positioning device consisting of the group of gimbals, wobble plates employing linear actuators and compact small angle positioning devices using polar coordinate system.

16. The method according to claim 13 wherein mounting the positioning device includes mounting a bi-axial gimbal to the satellite including a first uni-axial gimbal and a second uni-axial gimbal.

17. The method according to claim 16 wherein the first gimbal device moves in a direction of one of either a longitudinal or latitudinal direction relative to the Earth and the second gimbal device moves in the other of the longitudinal or latitudinal direction.

18. The method according to claim 13 wherein the antennas are antenna arrays.

* * * * *